US009966691B2

(12) United States Patent
Tsai et al.

(10) Patent No.: US 9,966,691 B2
(45) Date of Patent: May 8, 2018

(54) ELECTRONIC CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long-Fei Chen, New Taipei (TW); Chien-Tsung Chuang, New Taipei (TW); Yun-Jhong Wong, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days. days.

(21) Appl. No.: 15/359,824

(22) Filed: Nov. 23, 2016

(65) Prior Publication Data

US 2017/0149165 A1 May 25, 2017

(30) Foreign Application Priority Data

Nov. 24, 2015 (CN) ..... 2015 1 0823119

(51) Int. Cl.
*H01R 13/52* (2006.01)
*H01R 24/60* (2011.01)

(52) U.S. Cl.
CPC ..... *H01R 13/52* (2013.01); *H01R 13/5202* (2013.01); *H01R 24/60* (2013.01)

(58) Field of Classification Search
CPC ..... H01R 13/52; H01R 13/5202; H01R 24/60
USPC ..... 439/271
See application file for complete search history.

(56) References Cited

U.S. PATENT DOCUMENTS

| | | | | |
|---|---|---|---|---|
| 7,922,535 | B1 * | 4/2011 | Jiang | H01R 13/5205 439/271 |
| 8,388,380 | B1 * | 3/2013 | Van der Steen | H01R 13/5202 439/607.36 |
| 9,093,779 | B1 * | 7/2015 | Wang | H01R 13/521 |
| 9,337,588 | B2 * | 5/2016 | Chang | H01R 13/6594 |
| 9,362,680 | B2 * | 6/2016 | Kao | H01R 13/6583 |
| 9,391,391 | B2 * | 7/2016 | Chien | H01R 13/5202 |
| 9,425,560 | B1 * | 8/2016 | Su | H01R 13/506 |
| 9,444,177 | B2 * | 9/2016 | Tsai | H01R 13/5202 |
| 9,478,998 | B1 * | 10/2016 | Lapetina | H02J 7/0042 |
| 2013/0183844 | A1 * | 7/2013 | Wang | H01R 24/68 439/271 |

(Continued)

FOREIGN PATENT DOCUMENTS

| | | |
|---|---|---|
| TW | M493799 | 1/2015 |
| TW | M496259 | 2/2015 |
| TW | M505079 | 7/2015 |

*Primary Examiner* — Alexander Gilman
(74) *Attorney, Agent, or Firm* — Muncy, Geissler, Olds & Lowe, P.C.

(57) ABSTRACT

An electrical connector is provided, which includes: a housing having a port and an opening; an insulating body having a tongue plate formed in the housing; a plurality of conductive terminals provided on the insulating body; and a seal body formed between the tongue plate and the port. The tongue plate protrudes from the port to a region outside of the housing, such that the housing is free from enclosing the tongue plate. A seal body is provided between the tongue plate and the port to seal off the port so as to be waterproofed, without increasing the contour size of the electrical connector.

16 Claims, 3 Drawing Sheets

(56) References Cited

U.S. PATENT DOCUMENTS

| | | | | |
|---|---|---|---|---|
| 2014/0113497 | A1* | 4/2014 | Wang | H01R 13/52<br>439/660 |
| 2015/0236441 | A1* | 8/2015 | Kim | H01R 13/521<br>439/587 |

* cited by examiner

ELECTRONIC CONNECTOR

CROSS-REFERENCE TO RELATED APPLICATION(S)

This application claims priority to Chinese Patent Application No. 201510823119.3, filed on Nov. 24, 2015, the entirety of which is incorporated by reference herein.

BACKGROUND

Technical Field

The present disclosure relates to connectors, and, more particularly, to an electronic connector.

Description of Related Art

With the rapid development of electronics industry, modern electronic products nowadays include practical and diverse designs. Electronic connectors are connecting devices configured to electrically connect to cables, circuit boards, and other electronic components, and are widely applicable to a variety of electronic products, such as computers, laptop computers, mobile phones, etc.

Generally, an electronic connector is designed for various types of circuits, for example, a Universal Serial Bus (USB). USB Type-A configuration is widely used, while USB Micro-B is a smaller type of USB interface which is used in a mobile device or tablet.

In recent years, a USB Type-C is developed in order to be used in a lighter and more compact device, ad disclosed in Taiwan Patent No. M493799 or M505079. However, the USB Type-C electrical connector is not waterproof. Therefore a waterproof case is installed additionally by a person skilled in the art, for example in Taiwan Patent No. M496259.

However, in the aforementioned flat type electrical connector, the housing encloses the tongue plate. For example, in Taiwan Patent No. M493799, an iron case encloses a printed circuit board; in Taiwan Patent No. M505079 a housing encloses the base plate; and in Taiwan Patent No. M496259 an iron case encloses tongue plate. As such, the size of the corresponding plugin is restricted by the size of the housing, and the plugin cannot be inserted in the housing to electrically connect with the tongue plate. In other words, the selections of the plugins to be used are limited.

Moreover, since the housing encloses the tongue plate, it is required to have an even larger size for the waterproof case to enclose the housing, in order to achieve waterproof. Consequently, such as in Taiwan Patent No. M496259, the electrical connector can be extremely large, making it difficult to meet the requirement of miniaturization.

Therefore, there is an urgent need to solve the aforementioned problems.

SUMMARY

In view of the above described drawbacks, the present disclosure provides an electrical connector, which includes: a housing having a port and an opening on different sides of the housing; an insulating body having a base plate disposed inside the housing and a tongue plate extending from a side of the base plate and protruding from the port, such that the tongue plate is located outside the housing and has a first surface and a second surface; a plurality of first conductive terminals mounted on a first plate, each of the first conductive terminals having a first contact portion provided on the first surface and a first welding portion protruding from the opening; and a plurality of second conductive terminals mounted on a second plate, each of the second conductive terminals having a second contact portion provided on the second surface and a second welding portion protruding from the opening, wherein the first plate and the second plate are combined and formed on the insulating body.

The present disclosure also provides an electrical connector, which includes a housing having a port and an opening on different sides of the housing; an insulating body having a base plate disposed inside the housing and a tongue plate extending from a side of the base plate and protruding from the port, such that the tongue plate is located outside the housing and has a first surface and a second surface; a plurality of first conductive terminals mounted on a first plate, each of the first conductive terminals having a first contact portion provided on the first surface and a first welding portion protruding from the opening; and a plurality of second conductive terminals mounted on a second plate, each of the second conductive terminals having a second contact portion provided on the second surface and a second welding portion protruding from the opening, wherein the first plate and the second plate are combined and formed on the insulating body; and a seal body mounted between the tongue plate and the port and exposed from the port.

In an embodiment, the seal body has a ring-liked structure.

In an embodiment, the base plate is formed with a placement seat for the seal body to be disposed thereon.

In an embodiment, the base plate has an extending side, from which the tongue plate extends, and the extending side has an area larger than an area of the port.

In an embodiment, the port is formed on a front side of the housing, and the opening is in communication with a rear side and a bottom side of the housing.

In an embodiment, the first conductive terminals extend from the tongue plate in a direction toward the base plate, and bend and extend in another direction.

In an embodiment, the second conductive terminals extend from the tongue plate in a direction toward the base plate, and bend and extend in another direction.

In an embodiment, the electrical connector further comprises a shielding plate disposed between the first conductive terminal and the second conductive terminal.

From the above, the electrical connectors according to the present disclosure have a tongue plate protruding from the port, such that its plugin size can be adjusted based on practical needs, without being limited by the size of the port of the housing. In comparison with the prior art, the electrical connectors according to the present disclosure raise the possible selections of various types of plugins.

Moreover, since the housing is free from enclosing the tongue plate, it is only necessary to form a seal body between the tongue plate and the port in order to seal the port to be waterproofed, such that the contour size of the electrical connector would not increase. As such, the electrical connector not only has a waterproof effect, but also is compact and light weighted.

DETAILED DESCRIPTION

The following illustrative embodiments are provided to illustrate the present disclosure, these and other advantages and effects can be apparent to those skilled in the art after reading this specification.

It should be noted that structures, scales, sizes, etc., shown in all the drawings in reference with the specification, are not intended to limit the present disclosure, which merely facilitate the understanding and reading for those skilled in the art. Various modifications and variations in scale or sizes can be made without departing from the spirit of the present disclosure. Further, terms such as "upper", "lower", "front", "back", "left", "right", "first", "second", "on", "a" etc. are merely for illustrative purposes and should not be construed to limit the scope of the present disclosure, and any amendment or adjustment of relative relations without substantively changing technical content is rendered to be in the scope of the present disclosure.

Figure 1A:
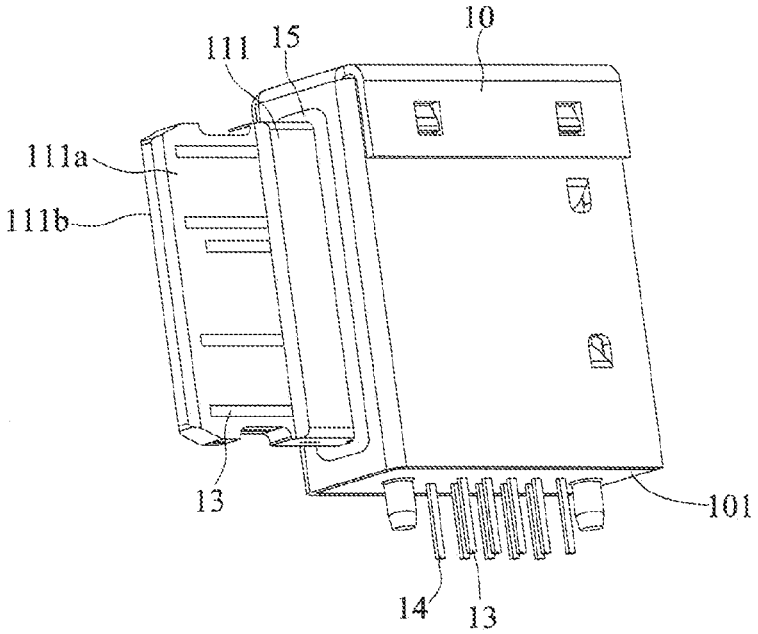
FIG. 1A is a schematic 3D view of an electronic connector according to the present disclosure.
Figure 1B:
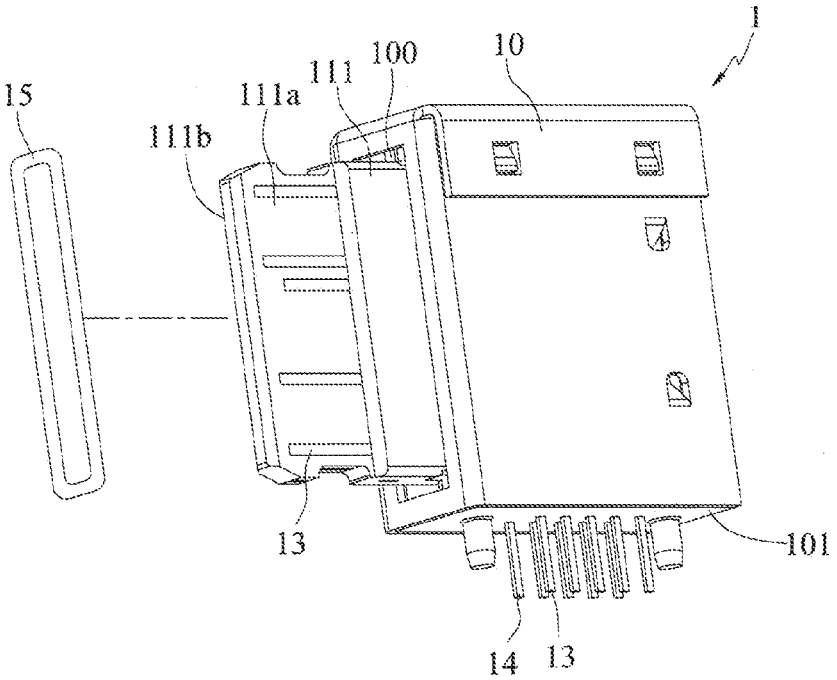
FIG. 1B is a partially exploded 3D view of the electronic connector of FIG. 1A.
Figure 1C:
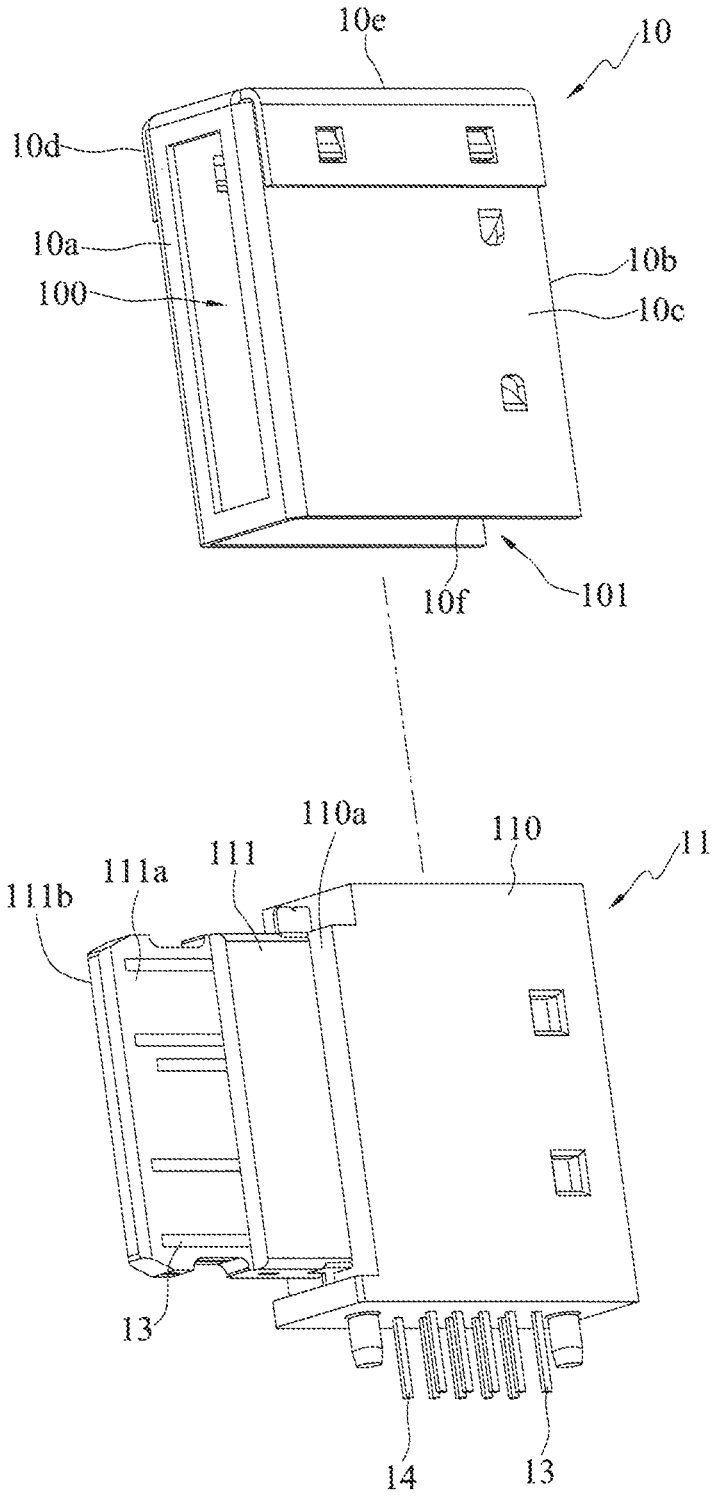
FIG. 1C is a partially exploded 3D view of the electronic connector of FIG. 1B.
Figure 1D:
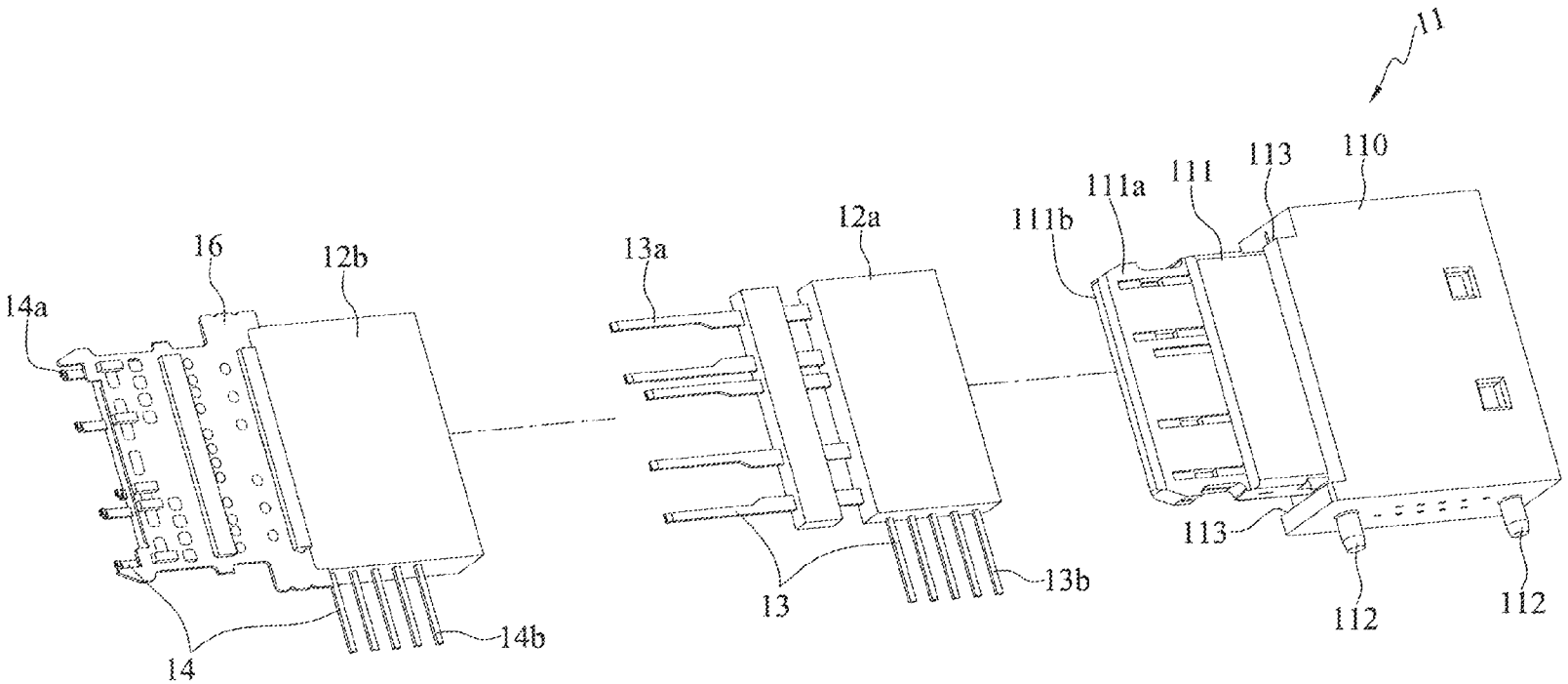
FIG. 1D is a partially exploded 3D view of the electronic connector of FIG. 1C.

Referring to FIGS. 1A-1D, schematic views of an electrical connector 1 according to the present disclosure are shown. The electrical connector 1 comprises a housing 10, an insulating body 11, a plurality of first conductive terminals 13, a plurality of second conductive terminals 14, a shielding plate 16, and a seal body 15.

In an embodiment, the electrical connector 1 is a Universal Serial Bus (USB) type, especially a USB Type-C, and is a vertical socket (that is the female connector commonly known by one of ordinary skill in the art) for the corresponding plugin (that is the male connector commonly known by one of ordinary skill in the art) to be plugged in. For example, the electrical connector 1 may act as the female connector for recharging.

The housing 10 has a port 100 and an opposing opening 101. In an embodiment, the housing 10 is a metal housing such as iron housing. The housing 10 is defined with a front side 10*a*, a rear side 10*b*, a left side 10*c*, a right side 10*d*, a top side 10*e* and a bottom side 10*f*, such that the port 100 is formed at the front side 10*a*, and an opening 101 is formed by connecting the rear side 10*b* and the bottom side 10*f*.

The insulating body 11 comprises a base plate 110 and a tongue plate 111. The base plate 110 is mounted inside the housing 10, and the base plate 110 has an extending side 110*a* for the tongue plate 111 to extend therefrom.

In an embodiment, the tongue plate 111 extends from the extending side 110*a* and protrudes from the port 100, such that the tongue plate 111 is located outside the housing 10. The tongue plate 111 is defined with a first surface 111*a* (such as a right surface) and a second surface 111*b* (such as a left surface).

In an embodiment, the area of the extending side 110*a* is larger than the area of the port 100, such that after the electrical connector 1 is assembled, the tongue plate 111 would protrude from the front side 10*a* of the housing 10, but the base plate 110 is restricted in the housing 10, without protruding from the front side 10*a* of the housing 10.

In an embodiment, the base plate 110 has a plurality of pins 112 extending downwardly, and the pins 112 are respectively located at the front side 10*a* and the rear side 10*b* of the housing 10, so as to assemble the insulating body 11 on an electronic device (not shown).

The first conductive terminals 13 are securely mounted on a first plate 12*a*, and each of the first conductive terminals 13 is defined with a first contact portion 13*a* on the first surface 111*a* and a first welding portion 13*b* protruding from the opening 101, wherein the first contact portion 13*a* protrudes from the port 100, and the first welding portion 13*b* is used to be electrically connected to the electronic device (not shown).

In an embodiment, each of the first conductive terminals 13 extends from the tongue plate 111 in a direction towards the base plate 110 and bends down to extend to the opening 101 of the bottom side 10*f*, to appear as an "L" shaped rod.

The second conductive terminals 14 are mounted on a second plate 12*b*, and each of the second conductive terminals 14 is defined with a second contact portion 14*a* formed on the second surface 111*b* and a second welding portion 14*b* protruding from the opening 101, wherein the second contact portion 14*a* protrudes from the port 100, and the second welding portion 14*b* is used to be electrically connected to the electronic device (not shown).

In an embodiment, each of the second conductive terminals 14 extends from the tongue plate 111 in a direction towards the base plate 110 and bends downwardly and further extend to the opening 101 of the bottom side 10*f*, to present like an ⌈L⌋ shaped rod.

In an embodiment, the first and second conductive terminals 13 include ground terminals (Gnd), power source terminals (Power/VBUS) and reserve terminals (RFU), and further include differential signal terminal pairs when needed.

The layout designs of USB conductive terminals are well known to persons skilled in the art, and will not be further elaborated here to define the conductive terminals and the layout.

In an embodiment, the first plate 12*a* and the second plate 12*b* are combined and formed on the insulating body 11. In another embodiment, a left side of the base plate 110 is formed with a recessed portion (not shown), to accommodate the first plate 12*a* therein, and the second plate 12*b* covers the recessed portion.

The shielding plate 16 is formed between the first conductive terminals 13 and the second conductive terminals 14 (especially between the first contact portion 13*a* and the second contact portion 14*a*), to isolate the first conductive terminals 13 from the second conductive terminals 14. Specifically, the first contact portion 13*a* and the shielding plate 16 are separated by the tongue plate 111, and the second contact portion 14*a* and the shielding plate 16 are separated by the second plate 12*b*.

In an embodiment, before the electrical connector 1 is assembled, the shielding plate 16, the first conductive terminals 13 and the second conductive terminals 14 are formed on the first plate 12*a* and the second plate 12*b*, and then enclosed in the base plate 110 and the tongue plate 111.

The seal body 15 is disposed between the insulating body 11 and the port 100, such that the seal body 15 is exposed from the port 100. In an embodiment, the seal body 15 has a ring-like structure, which is disposed at the front side 10*a* of the housing 10, such that together with the seal body 15 and the tongue plate 111, the port 100 of the housing 10 is sealed off to prevent any liquid or moisture entering the housing 10, and thereby achieve waterproof.

In an embodiment, the seal body 15 is an insulating washer or an elastic ring (so called an O-ring) for example. The base plate 110 is further formed with a placement seat 113 for the seal body 15 to be disposed thereon.

Moreover, during the assembly of the electrical connector 1, the seal body 15 is placed on the placement seat 113 to surround the base of the tongue plate 111, and then the insulating body 11 is inserted in the housing 10 through the rear side 10*b*, such that the base plate 110 is located inside the housing 10, and the tongue plate 111 (and each of the first contact portion 13*a* of the first conductive terminals 13 and each of the second contact portion 14*a* of the second conductive terminals 14) protrudes from the port 100, and the pins 112, each of first welding portion 13*b* of the first conductive terminals 13 and each of the second welding portion 14*b* of the second conductive terminals 14 protrude from the opening 101.

In an embodiment, the insulating body 11 may be inserted in the housing 10, and a waterproof glue is formed between the port 100 and the tongue plate 111 to fill the gap therein by a coating method, so as to form the seal body 15 when the waterproof glue is solidified.

Accordingly, the electrical connector 1 according to the present disclosure has the tongue plate 111 protruding from the port 100, such that its plugin size can be adjusted based on practical needs, without being limited by the size of the port 100 of the housing 10, and thereby increases the selections of the plugin types.

Moreover, because the housing 10 is free from enclosing the tongue plate 111, it is only necessary to form a seal body 15 between the tongue plate 111 and the port 100 to achieve waterproof, such that the contour size of the electrical connector 1 would not increase. That is, the contour size of the electrical connector 1 shown in FIG. 1A equals to the contour size of the structure on the right side of the electrical connector 1 shown in FIG. 1B, so as to reach the goal of miniaturization.

In summary, the electrical connector according to the present disclosure which features on the design that the tongue plate protrudes from the port can increase the selectivity of the plugin, and has the advantage of being waterproofed and compact size.

The above-described descriptions of the detailed embodiments are only to illustrate the preferred implementation according to the present disclosure, and it is not to limit the scope of the present disclosure. Accordingly, all modifications and variations completed by those with ordinary skill in the art should fall within the scope of present disclosure defined by the appended claims.

What is claimed is:

1. An electrical connector, comprising:

a housing of a case, the housing having a port and an opening on different sides of the housing;

an insulating body having a base plate disposed inside the housing and a tongue plate extending from a side of the base plate and protruding from the port with the tongue plate located outside the housing and having a first surface and a second surface;

a plurality of first conductive terminals mounted on a first plate, each of the first conductive terminals having a first contact portion provided on the first surface and a first welding portion protruding from the opening; and a plurality of second conductive terminals mounted on a second plate, each of the second conductive terminals having a second contact portion provided on the second surface and a second welding portion protruding from the opening, wherein the first plate and the second plate are combined and formed on the insulating body.

2. The electrical connector of claim 1, wherein the base plate has an extending side configured for the tongue plate to extend therefrom.

3. The electrical connector of claim 2, wherein the extending side has an area larger than an area of the port.

4. The electrical connector of claim 1, wherein the port is formed on a front side of the housing.

5. The electrical connector of claim 1, wherein the opening is in communication with a rear side and a bottom side of the housing.

6. The electrical connector of claim 1, wherein at least one of the first conductive terminals and the second conductive terminals extends from the tongue plate in a direction toward the base plate, and bends and extends in another direction different from the direction toward the base plate.

7. The electrical connector of claim 1, further comprising a shielding plate disposed between the first conductive terminal and the second conductive terminal.

8. An electrical connector, comprising:

a housing of a case, the housing having a port and an opening on different sides of the housing;

an insulating body having a base plate disposed inside the housing and a tongue plate extending from a side of the base plate and protruding from the port with the tongue plate located outside the housing and having a first surface and a second surface;

a plurality of first conductive terminals mounted on a first plate, each of the first conductive terminals having a first contact portion provided on the first surface and a first welding portion protruding from the opening;

a plurality of second conductive terminals mounted on a second plate, each of the second conductive terminals having a second contact portion provided on the second surface and a second welding portion protruding from the opening; and a seal body mounted between the tongue plate and the port and exposed from the port, wherein the first plate and the second plate are combined and formed on the insulating body.

9. The electrical connector of claim 8, wherein the seal body is ring-shaped.

10. The electrical connector of claim 8, wherein the base has a placement seat configured for the seal body to be disposed thereon.

11. The electrical connector of claim 8, wherein the base plate has an extending side configured for the tongue plate to extend therefrom.

12. The electrical connector of claim 11, wherein the extending side has an area larger than an area of the port.

13. The electrical connector of claim 8, wherein the port is formed on a front side of the housing.

14. The electrical connector of claim 8, wherein the opening is in communication with a rear side and a bottom side of the housing.

15. The electrical connector of claim 8, wherein at least one of the first conductive terminals and the second conductive terminals extends from the tongue plate in a direction toward the base plate, and bends and extends in another direction different from the direction toward the base plate.

16. The electrical connector of claim 8, further comprising a shielding plate disposed between the first conductive terminal and the second conductive terminal.

* * * * *